United States Patent [19]

Scherbing

[11] 4,403,485

[45] Sep. 13, 1983

[54] SLIDE FASTENER BAG LOCK

[75] Inventor: Frank J. Scherbing, Chicago, Ill.

[73] Assignee: Fort Lock Corporation, River Grove, Ill.

[21] Appl. No.: 304,856

[22] Filed: Sep. 23, 1981

Related U.S. Application Data

[63] Continuation-in-part of Ser. No. 150,968, May 19, 1980, abandoned.

[51] Int. Cl.[3] ..... E05B 17/04; E05B 67/38

[52] U.S. Cl. ..... 70/68; 70/379 R

[58] Field of Search ..... 70/68, 379 R, 380, 210, 70/67, 69–76; 24/205 R, 205.14 R, 205.14 K, 205.14 A

[56] References Cited

U.S. PATENT DOCUMENTS

| | | | |
|---|---|---|---|
| 1,598,551 | 8/1926 | Brouning | 70/379 R |
| 3,070,986 | 1/1963 | Hart | 70/68 |
| 3,580,016 | 5/1971 | Kerr | 70/68 |
| 3,653,236 | 4/1972 | Kerr | 70/68 |
| 3,785,185 | 1/1974 | Kerr | 70/68 |
| 4,019,353 | 4/1977 | Christopher | 70/68 |

*Primary Examiner*—Robert L. Wolfe

*Attorney, Agent, or Firm*—Leydig, Voit, Osann, Mayer & Holt, Ltd.

[57] ABSTRACT

An improved locking device, useful in, for example, a key-operated slide fastener bag lock of a type having a housing presenting an anvil to underlie a slide of a slide fastener and a rotatable keeper arm movable between an aligned position with respect to the anvil for confining the slide and a rotated out of the way position, and a lock cylinder disposed within the keeper arm, utilizes an actuator member having a cam surface and spring finger that actuate a locking pin when the keeper arm is aligned with the anvil and the lock cylinder rotated from an unlocked to a locked position or the lock cylinder is in a locked position and the keeper arm is moved into alignment with the anvil. The actuator member can be formed of a one piece, molded synthetic material, is light weight, economical to manufacture, and eases assembly as well as occupying a minimum of space, and may also function to limit the rotation of the key-operated lock cylinder within predetermined limits.

12 Claims, 26 Drawing Figures

SLIDE FASTENER BAG LOCK

CROSS REFERENCE TO RELATED APPLICATION

This application is a continuation-in-part of U.S. application Ser. No. 150,968, filed May 19, 1980 and now abandoned.

DESCRIPTION OF THE INVENTION

The present invention relates generally to an improved locking mechanism, and more particularly to an improved locking mechanism suitable for use as a slide fastener lock for flexible bags or pouches that are used for handling money, securities or even private papers.

Various slide fastener locks are illustrated and described in Hart U.S. Pat. No. 3,070,986 issued Jan. 1, 1963, entitled "Lock-Type Keeper Mechanism for a Slide Fastener"; Kerr U.S. Pat. No. 3,583,016 issued May 25, 1971, entitled "Keeper Lock for a Slide Fastener"; Kerr U.S. Pat. No. 3,653,236 issued Apr. 4, 1972 entitled "Keeper Lock for a Separable Fastener for a Money Bag or the Like"; Kerr U.S. Pat. No. 3,785,185 issued Jan. 15, 1974, entitled "Keeper Lock for a Slide Fastener"; and, Christopher U.S. Pat. No. 4,019,353 issued Apr. 26, 1977, entitled "Keeper Lock for a Slide Fastener." In its principle aspect, the present invention is concerned with the provision of a slide fastener bag lock improvement which overcomes certain problems and disadvantages present in such prior patented locks.

BACKGROUND OF THE INVENTION

The use of locks for slide fasteners on flexible money or security bags has long been established as indicated in the aforementioned patents. The principle reason for using such a lock is to seal the bag against unauthorized opening or gaining access to the contents without such access being discernable. In situations where such locked bags are being transported by bonded messenger, unless the lock, slide or bag shows physical signs of opening, insurance coverage may be disputed and disclaimed. More importantly, however, when private and confidential papers are being transported it may not be discovered whether unauthorized access has been obtained if the lock can be easily defeated such as by picking and then restored to its locked position. Thus, one of the requirements is that the lock should be of sufficiently high security that it is not easily picked or otherwise defeated.

In general, the basic structure of bag locks has remained the same over the years. It consists of a housing that is adapted to be fixed to the bag adjacent the end opening where the slide fastener reaches a closed position with the housing presenting an anvil portion underlying the zipper slide and a rotatable lever or keeper which carries the lock mechanism and is adapted to either overlie the anvil to confine the slide or to swing out of the way to release the slide for opening the bag. In one of the earlier versions as described in the Hart U.S. Pat. No. 3,070,986, the lock tumblers were the sole means for preventing the turning of the keeper arm. While it possessed one desirable advantage of enabling the removal of the key with the keeper in the open position and automatic locking upon shifting the keeper to the slide confining position, the lock itself was easily defeated. Indeed, it was not uncommon for such locks to simply pop open upon impact especially when dropped through a deposit chute since the lock structure weight at the one end of the bag tends to lead downward for impact at the bottom of the chute.

In subsequent approaches to overcome the afoementioned problems, such as in U.S. Pat. Nos. 3,580,016, 3,653,236 and 3,785,185, pop-up type keeper arms were employed which enabled inter-engaging elements of the keeper and housing in the closed position to protect the tumblers against any torque that may be applied to the keeper. One such arrangement, as shown in U.S. Pat. No. 3,653,236 even contemplated use of an axial pin tumbler type lock for greater pick resistant security. However, the pop-up type handle required a somewhat larger housing to allow for the relative axial movement of the keeper and additional mechanical locking mechanism was required. This added significantly to the massiveness of the lock as well as increasing the cost of manufacture.

One attempt to overcome the disadvantages of the pop-up type lock and return to the rotatable but fixed axially movable keeper arm is presented in U.S. Pat. No. 4,019,353. There, a lock bolt mechanism which is spring pressed is coupled to the lock cylinder and the bolt can be moved to free the handle for rotation or automatically be restored upon rotation of the keeper arm to the closed position. Again, the mechanism involved is such that possible operational difficulties may be encountered together with assembly problems and manufacturing costs involved.

SUMMARY AND OBJECTS OF THE INVENTION

The principle object of the present invention is to provide an improved locking device of the type having an axially fixed rotatable arm, which is suitable for use, for example, as a zipper slide bag lock, and which affords improved high security compared to conventional locking devices of this type, and yet is compact, dependable and economical.

A further object is to provide such a locking device in which the lock cylinder can be rotated to the key-locked position and the key removed while the arm is in the open position, and upon subsequently rotating the arm to the closed position, the arm will automatically lock.

It is another object to provide a lock of the foregoing type which has a minimum of easy to assembly components while being relatively foolproof in operation and sturdy in construction.

The invention also resides in the particular construction of an actuator member which can be made of a one piece, molded plastic that is lightweight, economical to manufacture and assemble in a lock as well as performing multiple functions of actuating a locking pin and limiting rotation of the lock cylinder.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention claimed herein.

DETAILED DESCRIPTION OF THE PREFERRED EMBODIMENT

Figure 1:
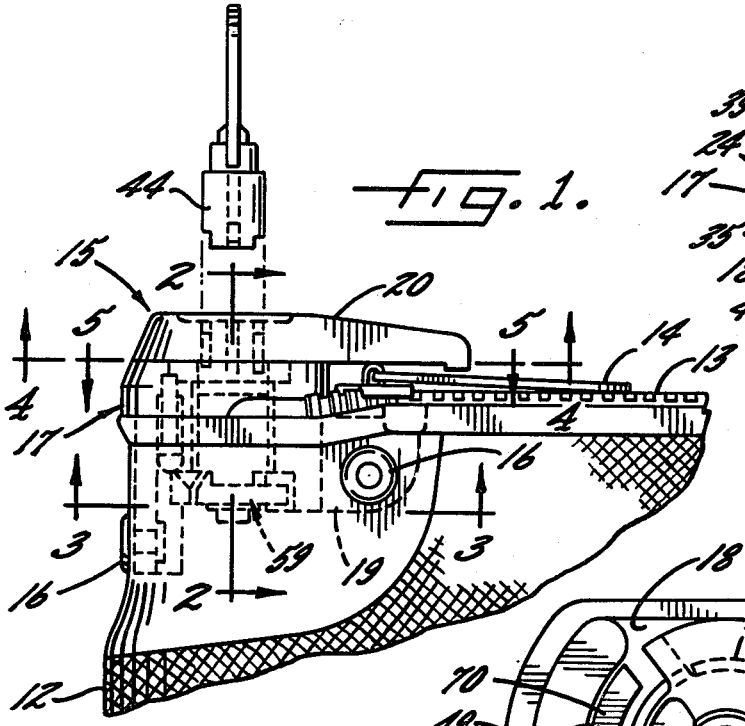
FIG. 1 is a side elevation view of the lock-containing corner region of an exemplary bag showing a zipper slide lock in accordance with the present invention in a locked position to confine the slide in a closed position and with a key ready to be inserted in the lock.

Turning to the figures, there is shown in FIG. 1 a typical locking device incorporating the present invention, as applied to a flexible bag 12 of the type generally used to contain and transport money or securities and the like such as used in banking or brokerage businesses. The bag 12 which may be of a small envelope size or a large pouch is generally formed of canvas or other backed, strong synthetic material that may be folded over and suitable sealed on all sides except the top which is provided with a slide-type fastener such as a tooth zipper 13 or the like to provide an access opening. Although not shown in the drawings, the opening and zipper typically extend partially down one side of the bag in addition to extending across the top to afford a wider access to the bag. As illustrated here, the zipper 13 is open and closed with a conventional slide 14.

As illustrated in FIG. 1, the lock, generally indicated at 15, is secured to the bag 12 at the upper left-hand corner by rivets 16, one passing transversely through the lock housing and the other longitudinally into the lock housing.

Figure 2:
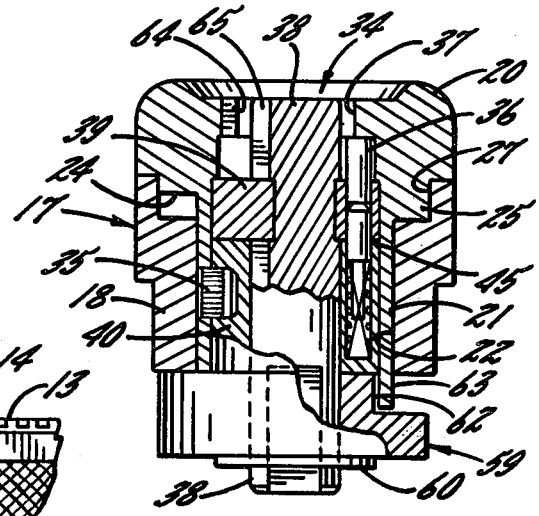
FIG. 2 is an enlarged transverse sectional view of the lock per se in its locked position taken substantially in the plane of line 2—2 in FIG. 1 with portions broken away to show the lock arrangement.
Figure 3:
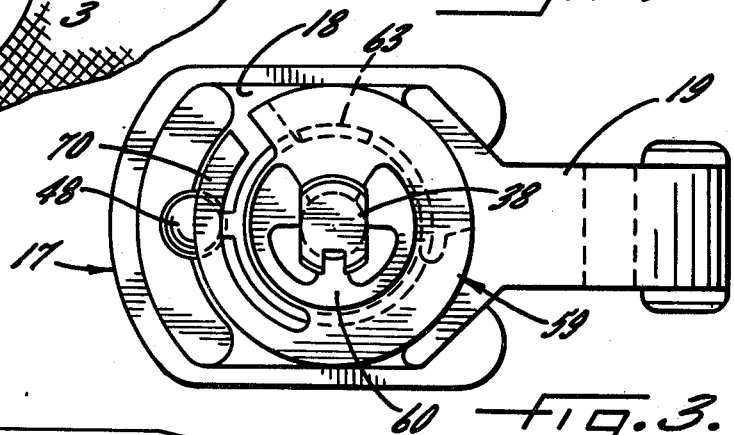
FIG. 3 is a bottom plan view of the housing and anvil of the lock per se taken substantially in the plane of line 3—3 in FIG. 1.
Figure 9A:
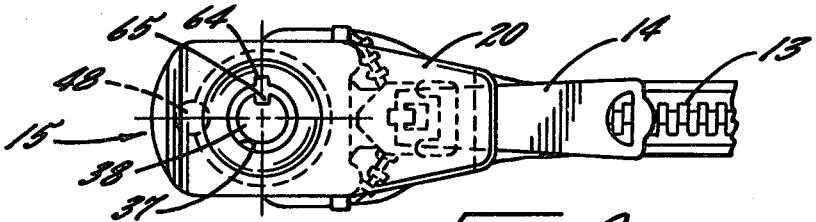
FIG. 9*a* is a top plan view of the lock shown in FIG. 1 in its locked condition with the keeper arm in a closed first angular position and the lock cylinder in the key locked position.
Figure 9B:
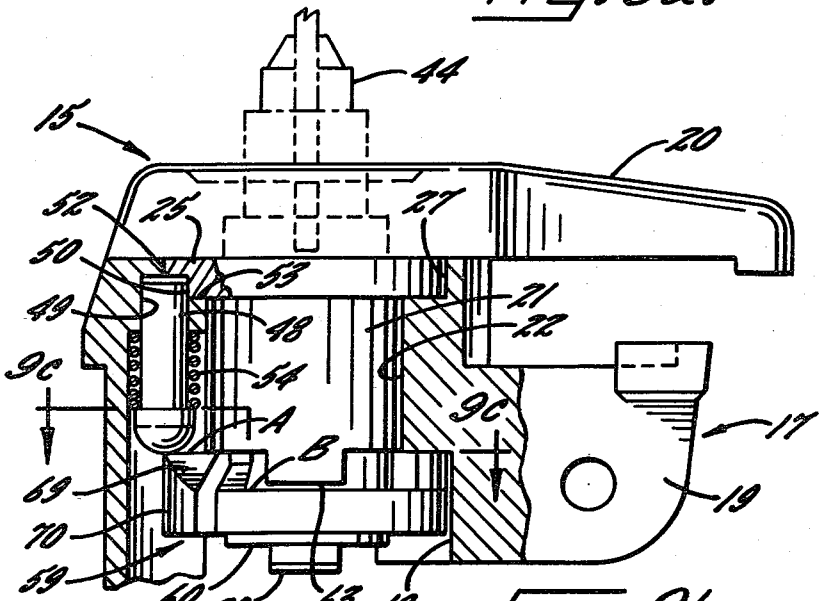
FIG. 9*b* is an enlarged side elevational view partly in section of the lock per se in the condition shown in FIG. 9*a*, showing the positions of the locking pin, locking pin engagement means, cam actuator member, and limiting element.

The lock 15 per se is more clearly illustrated in, for example, FIGS. 2 and 9*b*. The general arrangement of the lock 15 includes a one piece housing 17 having a generally cylindrical, tubularly cored portion 18 and an outwardly extending anvil portion 19. A handle or keeper arm 20 having a downwardly projecting cylindrical portion 21 telescopes into the tubular bore 22 of the housing 17.

Figure 10A:
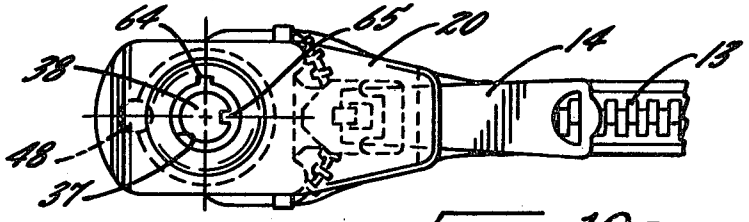
FIG. 10*a* is a top plan view similar to FIG. 9*a*, but with the lock shown in the condition wherein the lock cylinder is in the key unlocked and the keeper arm is closed, the key being omitted for purposes of clarity.
Figures 11A, 11B, 11C, 12A, 12B, 12C:
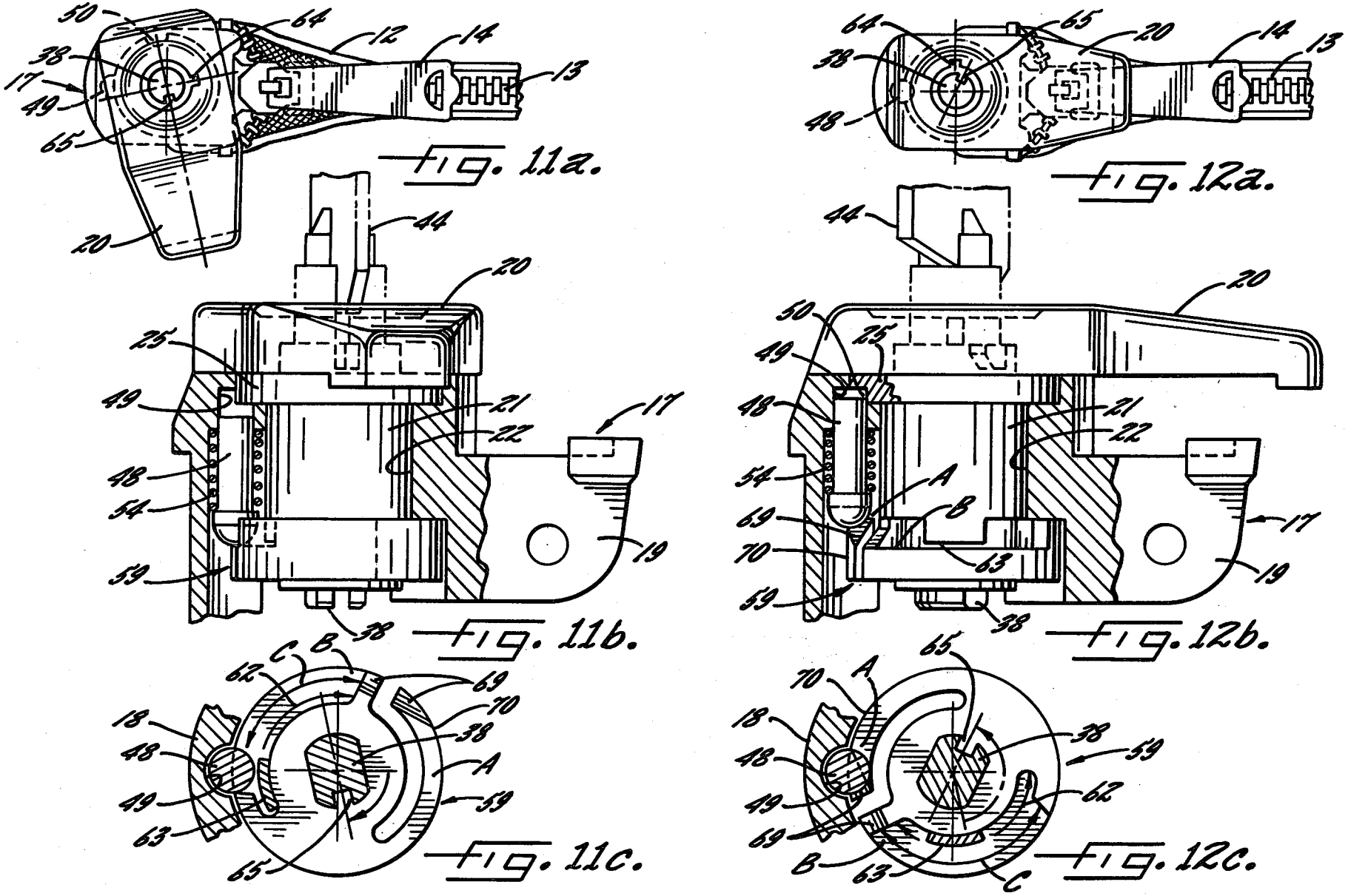
FIG. 11*a* is a top plan view similar to FIG. 9*a*, but with the lock shown in a condition wherein the lock cylinder is in the key unlocked position and the keeper arm is an open, second angular position, the key being omitted for purposes of clarity.
FIG. 11*b* is an enlarged side elevational view similar to FIG. 9*b*, but with the lock shown in the condition shown in FIG. 11*a*.
FIG. 11*c* is an enlarged top plan view similar to FIG. 9*c*, but with the lock shown in the condition shown in FIG. 11*a*.
FIG. 12*a* is a top plan view similar to FIG. 9*a*, but with the lock shown in the condition wherein the lock cylinder is in a position intermediate of the key-unlocked and key-locked positions and the keeper arm is closed, the key being omitted for purposes of clarity.
FIG. 12*b* is an enlarged side elevational view similar to FIG. 9*b*, but with the lock shown in the condition shown in FIG. 12*a*.
FIG. 12*c* is an enlarged top plan view similar to FIG. 9*c*, but with the lock shown in the condition shown in FIGS. 12*a* and 12*b*.

When the handle portion 20 is assembled with the housing 17, the handle may be rotated between the slide confining position shown in FIG. 10*a* and the open position shown in FIG. 11*a*.

Figure 4:
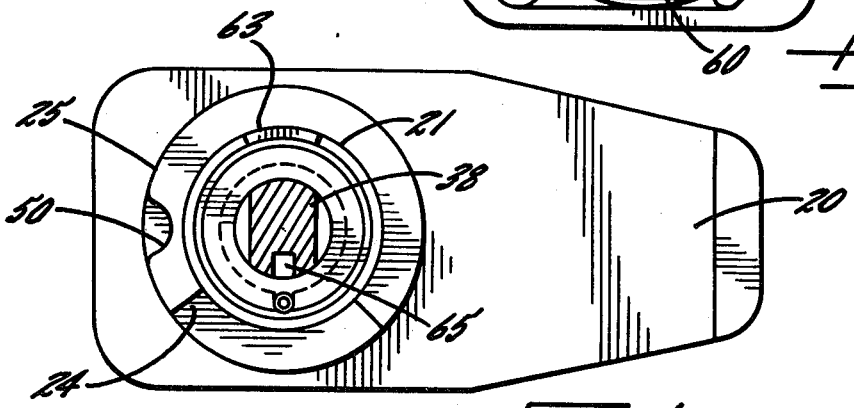
FIG. 4 is a detail plan view taken substantially in the plane of line 4—4 in FIG. 1 showing the underside of the keeper arm structure.
Figure 5:
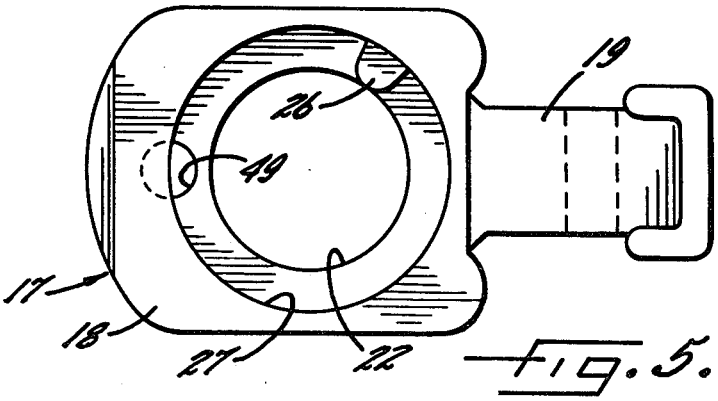
FIG. 5 is a top plan view taken substantially in the plane of line 5—5 in FIG. 6 showing the lock housing and anvil arrangement.

In order to better define the rotational limits of the keeper arm 20 with respect to the housing 17, mutual stop engagements are provided such as an arcuate recess 24 (FIG. 4) in annular rim 25 at the underside of the keeper arm and a projection 26 (FIG. 5) in annular cavity 27 surrounding the central bore 22 of housing 17.

The arcuate recess 24 extends approximately 90° and the arrangement is such that when the keeper arm 20 is in place the projection 26 rides within the recess 24 thereby limiting the movement of the keeper arm within the confines of the recess.

Figure 7:
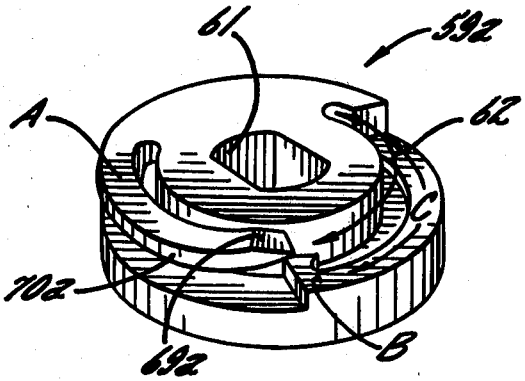
FIG. 7 is a perspective view of another embodiment of the cam actuator member having a spring finger and a cam surface.

A lock cylinder 34 is assembled into the keeper arm cylindrical portion 21 and held in place by retaining pin 35. In keeping with the desired high security aspect of the bag lock of the present invention, the lock cylinder 34, as best shown in FIG. 7, is desirably of the axial pin tumbler type which provides a rugged lock of high security. The axial orientation of the tumber pins 36, the annular key way 37 and other factors make the lock hard to pick or otherwise open by unauthorized means. Locks of this general type are illustrated in U.S. Pat. Nos. 3,041,086 and 3,509,748. It will be understood, however, as the discussion proceeds that the present invention is not limited to use with axial pin tumbler type locking devices but other type of key actuated locks preferably the most pick resistant types may be used if desired.

In general, the axial pin tumbler lock includes a central spindle 38 to which is secured a first sleeve 39 having a plurality of bores therein and a stationary sleeve 40 also having a plurality of bores therein with the sleeve 40 being fixed within the cylindrical protruding member 21 of keeper 20 by a retaining pin 35. The spindle sleeve bores carry a number of tumbler pins 36 arranged circumferentially around the annular key access of the lock mechanism which prevent rotation of the spindle 38 until a proper key 44 is inserted and aligns the tumbler pins with a radially oriented interface 45 between the first spindle sleeve 39 and the fixed sleeve 40.

In accordance with one aspect of the invention, as best illustrated in FIG. **9*b*, to securely lock the keeper arm in place when it is in the closed position, i.e., aligned with the anvil in the slide confining position, a locking pin 48 is carried in a bore 49 in the tubular portion of the housing so that the pin can be reversibly moved upwardly from a position in which the top end of the pin is spaced apart from the keeper arm to a position in which at least a portion of the top end of the pin projects from the housing and into restraining engagement with the keeper arm. The keeper arm is provided with cooperative means, such as a recess 50, for engagement with the locking pin. The bore 49** carrying the locking pin in substantially parallel to the keeper arm's axis of rotation.

As shown, for example, in FIG. **9*b*, the bore 49 and pin 48 are aligned with the vertical joint 52 formed between the annular rim 25 on the underside of the keeper arm and the annular cavity 27 on the top of the housing. The bore extends upwardly beyond the base 53 of the annular cavity 27, so that the locking pin can be moved upwardly in the bore until a section of the top end of the pin extends into the annular cavity while the remaining section of the top end of the pin is still carried in the housing. To provide engagement of the locking pin with the keeper arm, the annular rim 25 on the underside of the keeper arm is provided with a recess 50 which is aligned with the locking pin 48 when the keeper arm 20 is in the closed position. The recess 50** is sized to receive the section of the top end of the pin that extends into the annular cavity when the pin is moved upwardly in the bore. When the pin is raised into the recess it prevents rotation of the annular rim in the annular cavity, and thereby prevents rotation of the keeper arm.

For reasons that will become clear when the operation of the lock is discussed in detail, the locking pin 48 is provided with a spring 54 to normally urge the locking pin away from the keeper arm.

Figure 6:
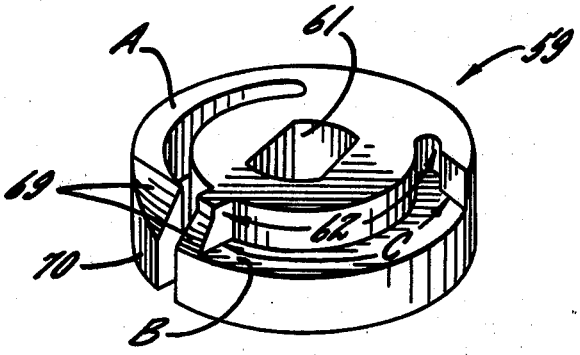
FIG. 6 is a perspective view of a preferred embodiment of the cam actuator member having a spring finger and a cam surface.
Figure 8:
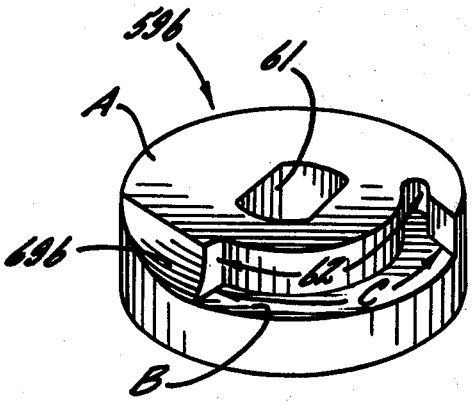
FIG. 8 is a perspective view of an alternate construction of the cam actuator member having a cam surface and no spring finger.

In accordance with an important aspect of the invention, an actuator cam member 59, various embodiments of which are illustrated in FIGS. 6–8, is attached to the lower end of the lock spindle 38 to perform the multiple functions, hereinafter described, of moving the locking pin 48 into engagement with the keeper arm and, conversely, allowing the locking pin to move out of engagement with the keeper arm in response to rotation of the lock spindle with respect to the lock housing, and of providing limits of rotation of the lock spindle with respect to the keeper arm.

To assemble the locking device, the lock cylinder 34 is inserted in the keeper arm cylindrical portion 21 and then held in place by retaining pin 35. It will be readily appreciated then that the keeper arm 20 containing the lock can be fitted over the housing portion 17. Once the keeper arm and lock are assembled to the housing 17 the locking pin 48 and spring 54 are positioned and then the actuator cam member 59 is positioned over the spindle 38 and held in place by a slip or retainer 60 (FIGS. 7 and 8) thereby completing the bag lock assembly.

The actuator cam member 59 is generally disk shaped with a central opening 61 corresponding in configuration to the shape of the spindle shaft 38. The spindle shaft and actuator opening are shaped to prevent rotation of the actuator on the spindle shaft. Thus, the actuator cam member and the lock spindle rotate together, and if the lock spindle 38 is rotated with respect to the lock housing 17, as by either turning the keeper arm or turning the lock spindle in the keeper arm, an arcuate portion of the upper surface of the actuator 59 passes under the bottom end of the locking pin 48.

The upper surface of the actuator cam member 59 includes an arcuate recess engagement means 62 for receiving a limiting element or tang 63 projecting downwardly from the cylindrical portion 21 of the keeper arm. Since the actuator cam member 59 is secured to the spindle shaft 38, rotation of the lock by the key 44 is limited to the confines of the recess 62 by reason of the tang 63 acting as a stop at each of the ends of the recess 62.

Additional important features of the actuator cam member 59 are described in conjunction with the following detailed discussion of the operation of the locking device.

In FIG. **9*a*, the bag lock is illustrated with the keeper arm 20 in the closed position and the lock spindle 38 in the key-locked position so that the slide 14 is confined and the bag is sealed. As shown in FIG. 9*a*, key way slot 64 and spindle slot 65, which conventionally receive, respectively, outwardly and inwardly extending lugs on the tubular key 44 (shown in FIG. 9*b*) are aligned with each other, so that a key can be inserted or removed, and both slots are disposed in what might be referred to as the "12 o'clock" position. With the keeper arm and lock spindle in this condition, as viewed in FIGS. 9*a* and 9*b*, the recess 50 in the keeper arm is aligned with the locking pin 48**, and the top end of the locking pin engages the recess.

In FIGS. **9*b* and 9*c* (and in FIGS. 10*b* through 14*c* as well) the lock is shown using the preferred actuator illustrated in FIG. 6**.

To hold the locking pin in its upward position with the top end of the pin engaged with the keeper arm, the cam actuator 59 member has a first upper surface portion A (see FIGS. 6, 9*b*, and 9*c*) which is positioned to contact the lower end of the locking pin 48 when the keeper arm 20 is closed and the lock spindle 38 is in the key-locked position. This portion A of the actuator is normally spaced apart from the keeper arm a distance such that the locking pin cannot move out of engagement with the keeper arm. The alternate embodiments of the cam actuator member (FIGS. 7 and 8) also have first upper surface portions A which perform this function.

Figure 9C:
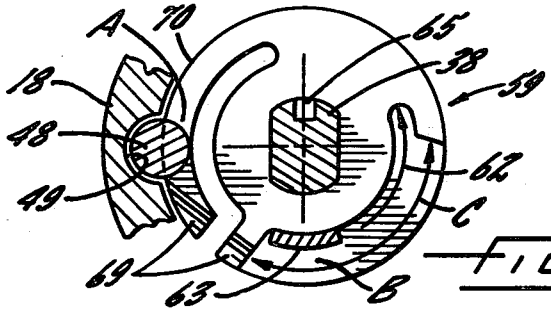
FIG. 9*c* is an enlarged top plan view of the lock in the condition shown in FIGS. 9*a* and 9*b*, taken partly in section and with portions removed showing the cam actuator member, locking pin, lock spindle, limiting element of the lock and a portion of the housing.

As is also shown in FIGS. 9*b* and 9*c*, when the keeper arm is closed and the lock spindle is in the key-locked position, tang 63 is adjacent the left-hand end of the recess engagement means 62, thereby preventing the key 44, actuator 59, and lock spindle 38 from being rotated further in the counterclockwise direction.

Upon insertion of the proper key 44 and rotation of the lock spindle 38 to the key-unlocked position, illustrated in FIG. 10*a*, the key way slot 64 moves out of alignment with the spindle slot 65. Because of the outwardly projecting lug on the tubular key, the key is confined at this stage and cannot be removed from the lock. If desired, another key way slot could be imposed in this position to allow removal of the key.

Figure 10B:
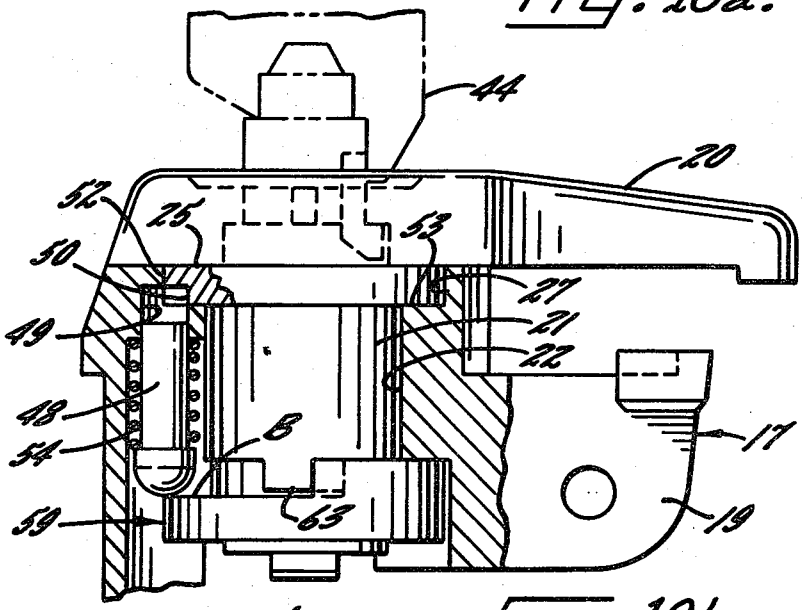
FIG. 10*b* is an enlarged side elevational view, similar to FIG. 9*b*, but with the lock shown in the condition shown in FIG. 10*a*.
Figure 10C:
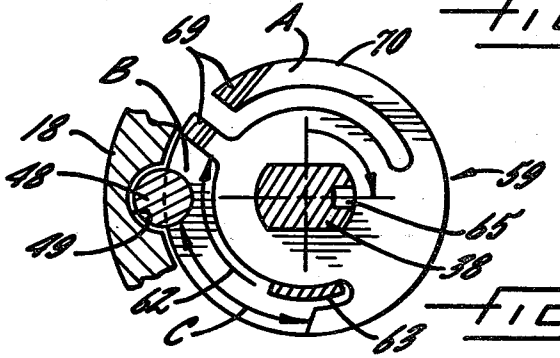
FIG. 10*c* is an enlarged top plan view, similar to FIG. 9*c*, but with the lock shown in the condition shown in FIG. 10*a*.

With rotation of the lock spindle 38 to the key-unlocked position shown in FIG. 10*a*, the actuator rotates and assumes the position shown in FIGS. 10*b* and 10*c*. In this position the tang 63 is disposed adjacent the right-hand end of the recess engagement means 62, preventing further rotation of the key 44, lock spindle 38, and actuator 59 in the clockwise direction, and a second upper surface portion B of the actuator underlies the locking pin. To permit downward movement of the locking pin so that it can move out of engagement with the keeper arm, the second upper surface portion B of the actuator is releatively lower than the first surface portion A. The alternate actuator structures shown in FIGS. 7 and 8 also have second upper surface portions B which perform this function. The spring 54 on the locking pin moves the locking pin downwardly out of engagement with the keeper arm when the recessed second surface portion B of the actuator is positioned beneath the locking pin.

To open the bag, the keeper arm is then rotated clockwise to a position illustrated in FIG. 11*a*. In this condition, the left end of the arcuate recess 24 (see FIG. 4) in the annular rim 25 of the keeper arm engages the projection 26 in the annular cavity surrounding the central bore of the housing, thereby preventing further rotation of the keeper arm in the clockwise direction. Rotation of the keeper arm 20 to the position shown in FIG. 11*a* likewise rotates the actuator cam 59. When the keeper arm is fully open, as illustrated in FIG. 11*a*, the actuator cam is in the position illustrated in FIGS. 11*b* and 11*c*.

To enable free rotation of the keeper arm 59 from the closed position illustrated in FIGS. 10*a*, 10*b*, and 10*c* to the open position illustrated in FIGS. 11*a*, 11*b*, and 11*c* when the lock spindle 38 is in the key-unlocked position, the arcuate upper surface portion C of the actuator that passes beneath the locking pin as the keeper arm is rotated between the closed and open positions is spaced apart from the keeper arm a sufficient distance so that the locking pin is not forced against the keeper arm.

In accordance with an important aspect of the invention, the bag can be locked in either of two ways.

Thus, starting from the condition illustrated in FIGS. 11*a*, 11*b*, and 11*c*, the lock can be returned to the condition illustrated in FIGS. 10*a*, 10*b*, and 10*c* by simply rotating the keeper arm counterclockwise. It should be noted that in the condition illustrated in FIG. 11*a*, the recess 50 in the keeper arm was not aligned with the locking pin.

When the keeper arm has been rotated back to the closed position shown in FIG. 10*a*, the recess 50 is aligned with the locking pin. The locking pin 48 can then be raised into engagement with the keeper arm by turning the key from the key-unlocked position to the key-locked position shown in FIGS. 9*a*, 9*b*, and 9*c*. As the key is rotated, the lock spindle 38 and actuator 59 also rotate. As shown in FIGS. 12*a*, 12*b*, and 12*c*, to smoothly lift the locking pin upward into engagement with the keeper arm, the actuator includes an inclined cam surface 69 on the upper surface portion of the actuator that passes beneath the locking pin as the actuator rotates between the position shown in FIGS. 10*b* and 10*c* and the position shown in FIGS. 9*b* and 9*c*. Each of the actuators illustrated in FIGS. 6, 7 and 8 has an inclined cam surface 69 with this function.

One of the desirable features of the preferred embodiment of the present invention is that the lock may also be locked in a second way. Starting from the condition shown in FIGS. 10*a*, 10*b* and 10*c*, the key 44 may be turned to restore the lock to a locked position while the keeper arm 20 remains in its open position, so that the lock assumes the condition illustrated in FIGS. 13*a*, 13*b* and 13*c*, whereupon the key can be removed. In this situation, the actuator cam 59 has been rotated counterclockwise and the tang 63 will still be in approximately the "9 o'clock" position, but it is now adjacent to the left-hand end of recess 62.

Figure 14A:
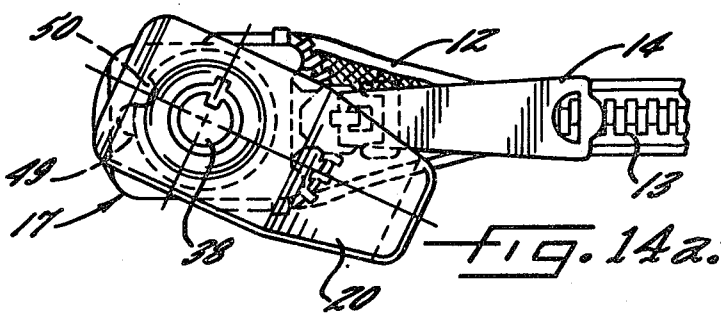
FIG. 14*a* is a top plan view similar to FIG. 9*a*, but with the lock shown in the condition wherein the lock cylinder is in the key-locked position and the keeper arm has been rotated partially from its open position toward its closed position.
Figure 14B:
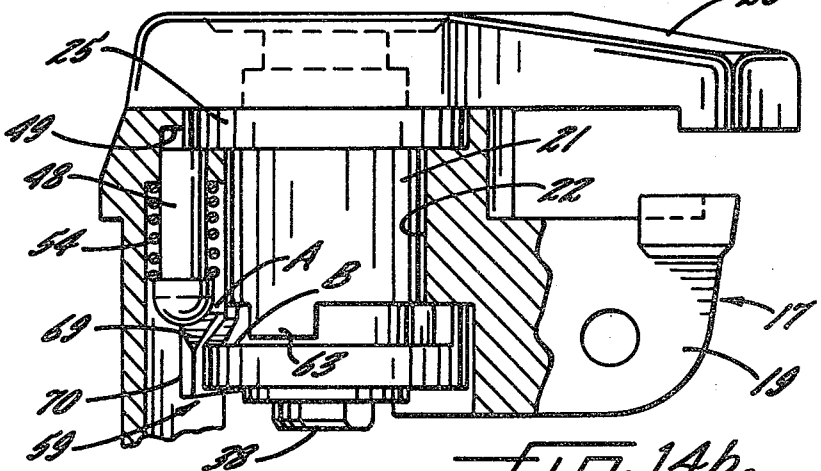
FIG. 14*b* is an enlarged side elevational view similar to FIG. 9*b*, but with the lock shown in the condition shown in FIG. 14*a*.
Figure 14C:
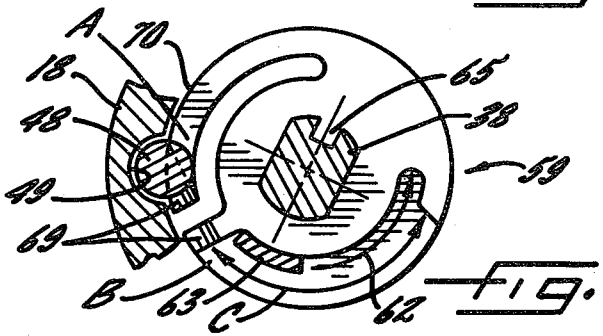
FIG. 14*c* is an enlarged top plan view similar to FIG. 9*c*, but with the lock shown in the condition shown in FIG. 14*a*.
Figure 13A:
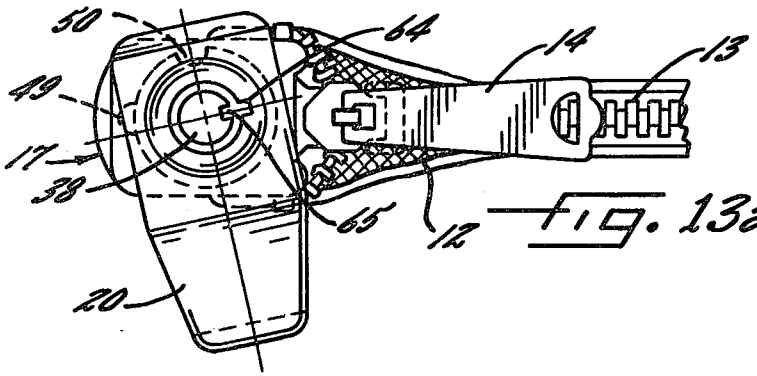
FIG. 13*a* is a top plan view similar to FIG. 9*a*, but with the lock shown in the condition wherein the lock cylinder is in the key-locked position and the keeper arm is open.
Figure 13B:
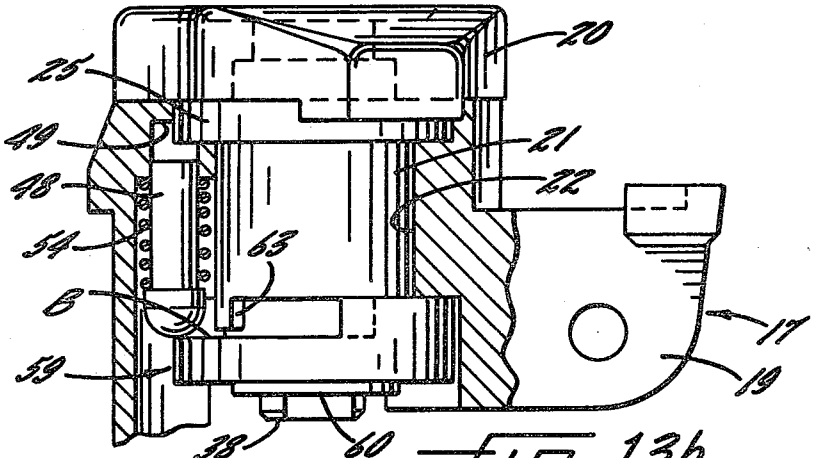
FIG. 13*b* is an enlarged side elevational view similar to FIG. 9*b*, but with the lock in the condition shown in FIG. 13*a*.
Figure 13C:
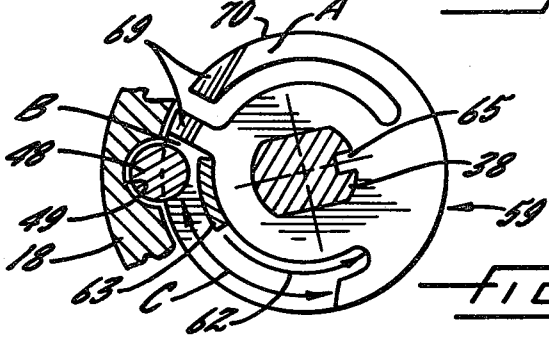
FIG. 13*c* is an enlarged top plan view similar to FIG. 9*c*, but with the lock shown in the condition shown in FIG. 13*a*.

At this point, counterclockwise rotation of the keeper arm will likewise rotate the actuator and thereby bring the cam surface 69 of the actuator beneath the locking pin 48, forcing the pin to move upwardly in the housing, as shown in FIGS. 14*a*, 14*b* and 14*c*. The recess 50 in the keeper arm is not aligned with the locking pin 48 (see FIG. 14*a*) until the keeper arm 20 is completely closed. Continued rotation of the keeper arm after the locking pin has contacted the keeper arm is possible, however, when a cam member having a spring finger 70 is used, because the spring finger 70 is temporarily forced downwardly to provide clearance for the locking pin, as shown in FIG. 14*b*. When the keeper arm has reached the closed position and the recess 50 has moved into alignment with the locking pin, the locking pin is automatically popped into the recess by the force exerted by the spring finger. Thus, when an actuator having a spring finger is used, the lock spindle 38 can be returned to the key-locked position with the keeper arm open, the key can be removed, and the keeper arm is thereafter self-locking without any need for further use of the key. The actuator cam members illustrated in FIGS. 6 and 7 each have a spring finger 70 with this function.

From the standpoint of economy of manufacture and weight savings, the actuator cam member 59 may be made as a one-piece molded part formed of a suitable synthetic or plastic material such as nylon or nylon reinforced with glass fibers. Using this approach, spring finger 70 can be formed integrally with the cam actuating member. The cam actuator 59 could also be, for example, a die cast metal member or a stamped metal member. The spring finger 70 could be a separate element of spring-like material attached to the disk 59.

I claim:

1. A locking device comprising, in combination:

a housing having a tubular opening therein, an arm means including a cylindrical portion that is telescopically received in the tubular opening of said housing so that the arm means can be rotatably turned between a first angular position and a second angular position, a key receiving locking mechanism carried by said arm means, including a spindle member that projects within the housing and is rotatable between a key-unlocked and a key-locked position by a proper key inserted in a keyway presented in said arm means, locking pin means disposed within said housing and adapted to be movable into restraining engagement with said arm means when said arm means is in the first angular position, said pin being movable away from the arm means to release the arm means for rotation to said second angular position when the lock mechanism is in the key-unlocked position, and an actuator member adapted to be secured to said lock spindle for rotation therewith, said actuator member having means to move the locking pin into engagement with said arm means when the arm is in the first angular position and the lock spindle is rotated from the key-unlocked to the key-locked position.

2. A locking device as claimed in claim 1 wherein said means to move the locking pin into engagement with said arm means includes a spring finger means.

3. A locking device as claimed in claim 1 wherein said means to move the locking pin into engagement with said arm means includes a cam surface.

4. A locking device as claimed in claim 1 wherein said actuator member is substantially disk shaped and has spring finger means for moving said locking pin into restraining engagement with the arm when the arm is rotated from the second angular position to the first angular position while the lock spindle is in the key-locked position.

5. A locking device as claimed in claim 3 wherein said spring finger of the actuator member is arcuate and extends on a predetermined portion of the circumference of the disk and said actuator includes an arcuate engagement means extending over another predetermined portion of the circumference of the disk for limiting the rotation of the lock spindle with respect to the arm means.

6. A locking device as claimed in claim 1 wherein said actuator is an integrally moulded one-piece part.

7. A locking device as claimed in claim 1 wherein the lock is an axial pin tumbler lock.

8. A locking device as claimed in claim 1 wherein said arm means and housing include engageable stop means to limit relative rotation between predetermined limits.

9. A locking device for securing a slide of a slide fastener comprising, in combination:

a housing having a tubular opening therein and an extending portion presenting an anvil to underlie the slide of said slide fastener, a keeper arm means telescopically received in said tubular opening of said housing adapted to be rotatably turned between a position overlying said anvil to confine the slide therebetween and an angularly open position with respect to said anvil to free the slide, a key receiving locking mechanism carried by said keeper arm, including a spindle member that projects within the housing and is rotatable between a key-unlocked and a key-locked position by a proper key inserted in a key way presented in said keeper arm, locking pin means disposed within said housing and adapted to be movable into restraining engagement with said keeper arm when said arm is in the aligned position with respect to said anvil, said pin being movable away from the keeper arm to release the arm for rotation when the lock spindle is in the key-unlocked position, and an actuator member adapted to be secured to said lock cylinder spindle for rotation therewith, said actuator having means to move the locking pin into engagement with said keeper arm when the arm is in the aligned position with the anvil and the lock spindle is rotated from the key-unlocked to the key-locked position.

10. A locking device as claimed in claim 9 wherein said actuator member is substantially disk shaped, has spring finger means and cam means to move the locking pin into engagement with said keeper arm when the arm is in the aligned position with the anvil and the lock spindle is rotated from the key-unlocked to the key-locked position or the keeper arm is rotated from the unaligned to the aligned position while the lock spindle is in the key-locked position, and includes an arcuate engagement means extending over a predetermined portion of the circumference of the disk for limiting the rotation of the lock spindle with respect to the keeper arm.

11. For use in a locking device including a housing having a tubular opening therein, an arm means including a cylindrical portion that is telescopically received in the tubular opening of said housing so that the arm means can be rotatably turned between a first angular position and a second angular position, a key receiving locking mechanism carried by said arm means including a spindle member that projects within the housing and is rotatable between a key-unlocked and a key-locked position by a proper key inserted in a keyway presented in said arm means, and locking pin means disposed within said housing and adapted to be movable into restraining engagement with said arm means when said arm means is in the first angular position, said pin being movable away from the arm means to release the arm means for rotation to said second angular position when the lock mechanism is in the key-unlocked position, the combination comprising:

a substantially disk shaped actuator cam member adapted to be secured to said lock spindle for rotation therewith, said actuator having means for moving said locking pin into restraining engagement with the arm when the arm is in said first angular position and the lock spindle is rotated from the key-unlocked to the key-locked position or the arm is rotated from the second angular position to the first angular position while the lock cylinder is in the key-locked position.

12. An actuator cam member as claimed in claim 11 wherein said means for moving said locking pin includes an arcuate spring finger that extends on a predetermined portion of the circumference of the disk, and said disk includes an arcuate engagement means extending over another predetermined portion of the circumference for limiting the rotation of the lock spindle with respect to said arm means.

* * * * *